United States Patent [19]

Barnett

[11] 4,191,490

[45] Mar. 4, 1980

[54] PRESTRESSED CONCRETE ROADWAY

[75] Inventor: George D. Barnett, Palm Desert, Calif.

[73] Assignee: Barnett, Haynes & Barnett, International, Palm Desert, Calif.

[21] Appl. No.: 936,814

[22] Filed: Aug. 25, 1978

Related U.S. Application Data

[63] Continuation-in-part of Ser. No. 814,993, Jul. 12, 1977, abandoned.

[51] Int. Cl.[2] ..... E01C 5/08

[52] U.S. Cl. ..... 404/70; 52/226

[58] Field of Search ..... 404/70, 17, 27; 52/226, 52/223 R; 425/63

[56] References Cited

U.S. PATENT DOCUMENTS

| | | | |
|---|---|---|---|
| 2,590,685 | 3/1952 | Coff | 404/70 |
| 2,655,846 | 10/1953 | Freyssinet | 404/70 |
| 2,833,186 | 5/1958 | Dobell | 404/70 X |
| 3,072,994 | 1/1963 | Brickman | 404/70 X |
| 3,156,169 | 11/1964 | Finsterwalder | 404/70 |
| 3,182,109 | 5/1965 | Greulich | 404/70 X |

FOREIGN PATENT DOCUMENTS

| | | | |
|---|---|---|---|
| 758624 | of 1956 | United Kingdom | 404/70 |

*Primary Examiner*—Nile C. Byers, Jr.
*Attorney, Agent, or Firm*—Cahill, Sutton & Thomas

[57] ABSTRACT

A concrete slab is provided with prestressing cables to be post-tensioned upon setting of the concrete. The post-tensioning cables or strands are equally spaced on predetermined centers and are angled with respect to the longitudinal axis of the slab. All of the strands are parallel and are substantially co-planar with all other strands. The angle between the longitudinal axis of the slab and the strands ranges from approximately 2° to approximately 60°.

8 Claims, 3 Drawing Figures

PRESTRESSED CONCRETE ROADWAY

This application is a continuation-in-part application of an application entitled "PRESTRESSED CONCRETE ROADWAY", filed July 12, 1977, assigned Ser. No. 814,993, and describing an invention made by the present inventor now abandoned.

The present invention pertains to prestressed concrete slabs and, more particularly, to concrete slabs of the type used in roadways (both highways and railroads).

Concrete slab construction incorporating reinforcing steel or prestressing steel has long been known in the art. Typically, in prestressed concrete slab construction, the steel strands are either pre-tensioned or post-tensioned. In roadway applications, it has been suggested that the individual strands be sheathed in a tubular layer of plastic or other material that is impervious to the plastic concrete such that the strands may be allowed to move and stretch after the concrete has become set. Such post-tensioning techniques have been described, for example, in U.S. Pat. Nos. 2,833,186, 2,950,517 and 3,182,109. In the prior art, of which the above referenced patents are part, post-tensioning strands are embedded in the phastic concrete and are subsequently tensioned when the concrete sets. However, uniformly throughout the above prior art, the requirement has been either implied or explicity stated that a uniform intersecting pattern of steel post-tensioning strands is required.

The post-tensioning strands of the prior art normally criss-cross such that two layers of strands are formed; the fist layer incorporates evenly spaced parallel strands and the second layer incorporates evenly spaced parallel strands that extend at a predetermined angle with respect to the longitudinal axis of the roadway or slab as well as a predetermined angular relation with respect to the strands of the first layer. While the symmetry afforded by such double layer strand technique impliedly dictates uniform compressive strength in the resulting prestressed slab, it also intuitively would appear that the symmetrical criss-crossing of the respective strands is required. The post-tensioning of the strands of the prior art presents anchoring difficulties. That is, the anchors for the strands extending in one direction sometimes interfere with the proper of convenient positioning of the anchors for the strands extending in the other direction. Further, the angular relationship of the respective layers of strands can interfere with automation or simplifying the procedure of laying the roadway.

Some prior art roadways have used longitudinally extending post-tensioned strands; however, such technique requires a gap in every section to gain access to strand ends so that the corresponding section can be post-tensioned.

It is therefore an object of the present invention to provide a prestressed concrete roadway incorporating post-tensioning strands all of which are parallel.

It is another object of the present invention to provide a prestressed concrete roadway having post-tensioning strands, positioned at a predetermined angular relationship with respect to the axis of the roadway, which strands all extend in a single plane.

It is yet another object of the present invention to provide a roadway construction incorporating prestressed concrete having post-tensioning cables or strands that extend at an angle with respect to the longitudinal axis of the roadway within a predetermined range of angles.

These and other objects of the present invention will become apparent to those skilled in the art as the description thereof proceeds.

Briefly, in accordance with one embodiment chosen for illustration, a concrete roadway slab is formed utilizing conventional concrete forming techniques. A plurality of post-tensioning strands are positioned in the forms prior to the pouring of the concrete. Each of the strands is formed from a conventional high tensile strength steel having a flexible plastic sheath thereabout to permit post-tensioning. Upon setting of the concrete, the strands are tensioned to a predetermined value. All of the strands are co-planar and all strands are parallel to each other. A single layer of parallel strands is thus provided in the roadway to derive an appropriate ratio of longitudinal to transverse compressive load.

The present invention may more readily be described by reference to the accompanying drawings, in which.

Figure 1:
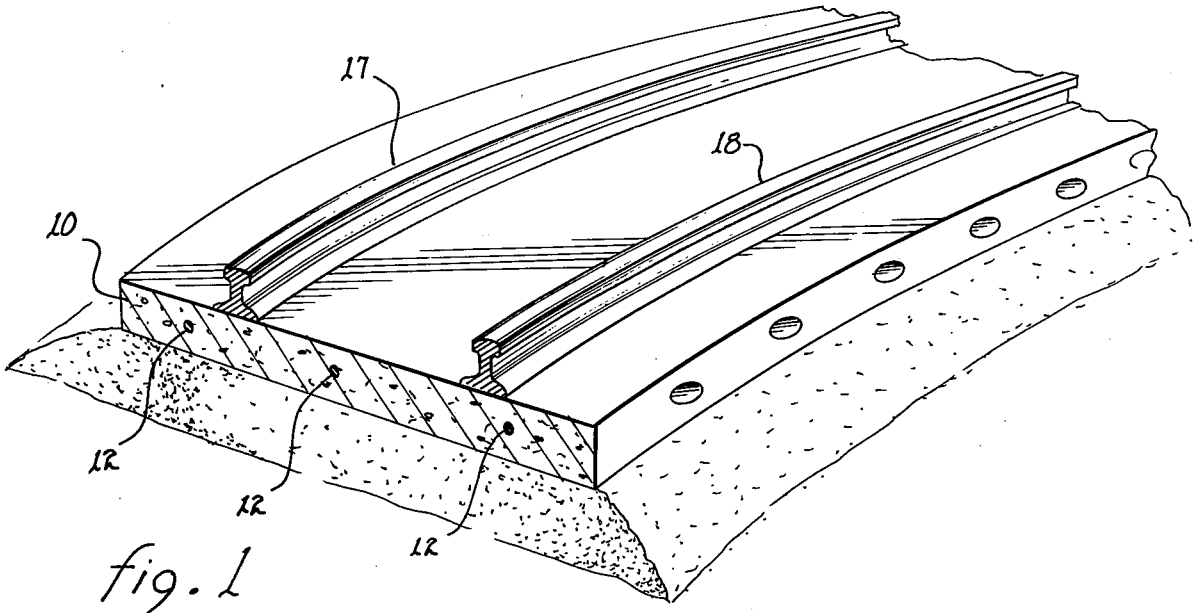
FIG. 1 is a perspective view of a concrete roadway constructed in accordance with the teachings of the present invention showing the roadway utilized in a railroad bed environment.
Figure 2:
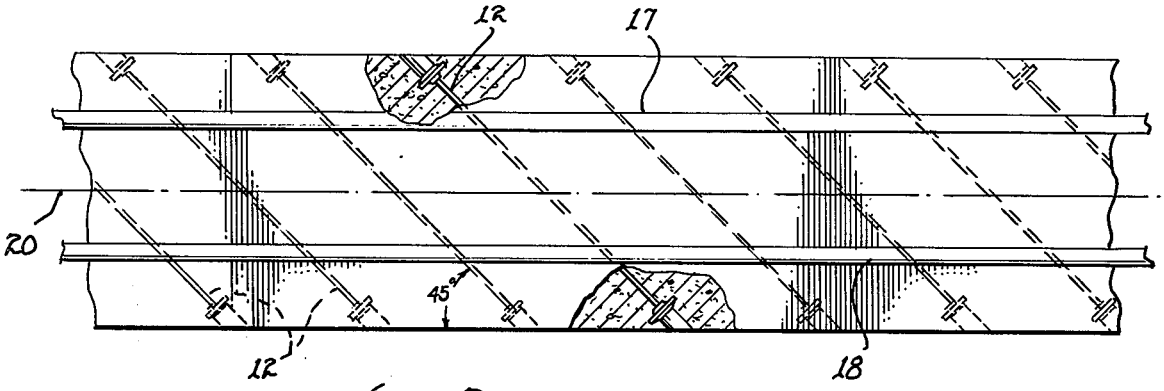
FIG. 2 is a schematic top view of the roadway of FIG. 1.

Referring now to the drawings, and particularly to FIGS. 1 and 2, a continuous concrete slab 10 is formed from conventional roadway concrete such as 4,000 psi stone aggregate concrete having a conventional 4 inch slump. The roadway incorporates post-tensioning cables 12 distributed on 24 inch centers extending from one side of the 8 foot 6 inch roadbed to the other. The slab 10 may conventionally have a 6 inch thickness with the post-tensioning strands 12 positioned approximately midway in the slab thickness. The post-tensioning strands are conventional seven wire type having a center wire enclosed by six helically placed outer wires and may be of ASTM Grade 270. The strands generally will conform to ASTM Standard A 416. The strands are enclosed in a flexible plastic sheath to permit the strands to move relative to the concrete during post-tensioning and to permit the strands to uniformly compress the surrounding concrete without binding at any point throughout the strands' length. The strands, in the embodiment chosen in FIGS. 1 and 2, are positioned at an angle of 45° with respect to the longitudinal axis of the roadway.

In a railroad environment such as that shown in FIGS. 1 and 2, it has been found that the 45° angular relationship of the respective strands (providing an appropriate 1:1 compressive relationship betwen longitudinal and transverse compression) is most desirable although the other angular relationships may be used within the range of approximately 2° to approximately 60°. The individual strands are anchored using well known techniques such as the system presently available from Western Concrete Structures Corporation of Gardena, California. Typically, a roadway such as that described above, will use post-tensioning strands as set forth in the above described ASTM Standard having one half inch diameters and will be placed on 24 inch centers along the roadway. After the concrete slab sets, the individual strands will be post-tensioned using electrical or hydraulic stressing equipment to a load of approximately 28,900 pounds which will result in effective tensile force in each strand of 25,000 pounds. The stressing equipment may take any of several well known forms such as the euipment presently available from the above identified company.

Since the roadway of FIGS. 1 and 2 is intended for use in a railroad environment, conventional railroad rails 17 and 18 are secured to the slab 10 in any conventional manner. For example, concrete tie-fastening systems such as the presently known Pandrol heavy duty fastening system, may be used. The Pandrol fastener system is well known and need not be described here.

Figure 3:
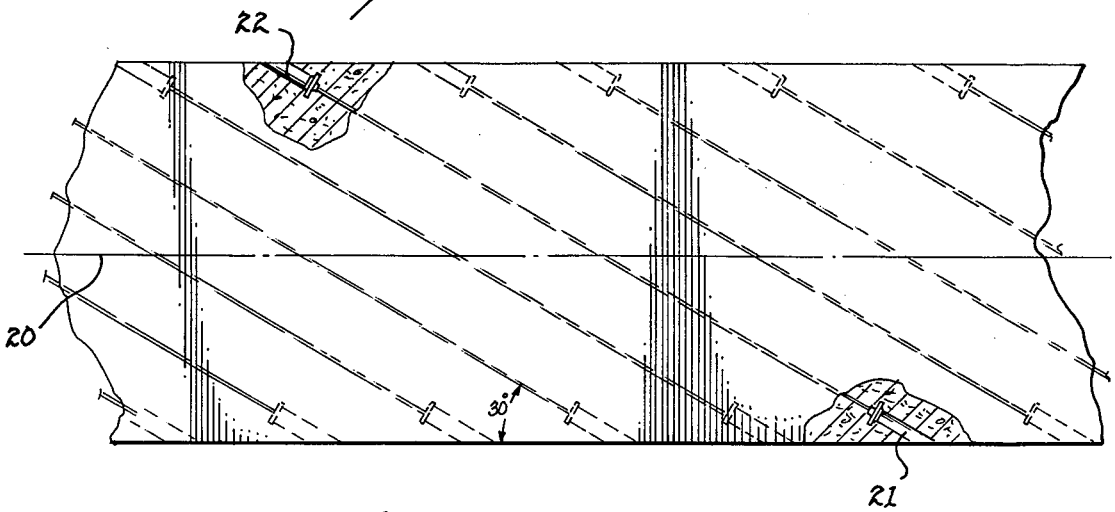
FIG. 3 is a schematic view of a typical highway concrete roadway constructed in accordance with the teachings of the present invention.

Referring to FIG. 3, a schematic diagram is shown of a roadway concrete slab constructed in accordance with the teachings of the present invention and intended for use with highways. The individual strands embedded in the concrete slab may be formed from post-tensioning strands described in connection with the embodiment of FIGS. 1 and 2. The strands in FIG. 3, however, can be positioned at an angle in the range from approximately 2° to approximately 60° with respect to the longitudinal axis 20 of the roadway. For a minimum width roadway slab, and for strands with lengths in the range from 450–600 feet, the angle between the strands and the longitudinal axis of the roadway may be as low as approximately 2°. Longer length strands are impractical, since friction between the roadway slab and the underlying ground will tend to unduly reduce the compression force applied to the post-tensioned concrete slab.

Those skilled in the art will recognize that the above described post-tensioning system produces asymmetrical compressive forces on the concrete slab. This is because all of the strands are parallel. (In contrast, symmetrical compressive forces are produced on the concrete slab by the symmetrical diagonal tensioning system described in U.S. Pat. No. 2,833,186, previously mentioned.) The above mentioned asymmetrical compressive forces produce large internal shear stresses in the concrete slab section. The above described angle, which is measured between the strands and the longitudinal axis of the concrete roadway slab, is selected such that the longitudinal compressive force exceeds a predetermined magnitude and the shear stress is sufficiently low to avoid significant weakening of the poured-in-place concrete slab section.

Pockets, such as those shown at 21 and 22, may be provided in the roadway to accommodate stress anchor at each of the respective strands. The pockets along the edge of the roadway will normally be covered with a suitable grouting mixture to enclose the pockets. Such pockets will also appear in the embodiment shown in FIGS. 1 and 2. It may be noted that all of the strands in the roadway of the present invention are parallel with respect to each other and all are positioned at the same given angle with respect to the longitudinal axis of the roadway. The strands are essentially all co-planar with respect to each other and form a single layer within the roadway. All of the ends of the strands extend from the edges of the roadway in the identical direction to permit rapid post-tensioning without interference from strands exiting the edge of the roadway from a criss-crossing or opposite direction.

Since each of the strands is positioned parallel with each other strand, the routine or repetitive technique utilized by the road laying crew is greatly simplified and the strands can be easily positioned prior to or during the laying of the plastic concrete. Further, upon setting of the concrete, the post-tensioning crew can operate efficiently and can successively post-tension each strand in proper sequence. The construction of the present invention lends itself to continuous and automatic roadway laying techniques without undue complications that would arise from the utilization of two-plane criss-crossing double layered post-tensioning strand arrangements such as those shown in the prior art.

I claim:

1. A section of prestressed concrete roadway comprising:

a. a poured-in-place concrete slab section having predetermined thickness, width, and length and having a longitudinal axis, said poured-in-place concrete slab section having first and second opposed edges;

b. a plurality of post-tensioned diagonal strands distributed at predetermined intervals in said concrete slab section, each of said post-tensioned diagonal strands being substantially parallel to all of the others of said post-tensioned diagonal strands, each of said post-tensioned diagonal strands being oriented at a predetermined angle with respect to said longitudinal axis, each of said post-tensioned diagonal strands having first and second ends, respectively, said first end of each of said post-tensioned diagonal strands being anchored into said poured-in-place concrete slab section along said first edge, said second end of each of said post-tensioned diagonal strands being anchored into said poured-in-place concrete slab section along said second edge, said poured-in-place concrete slab section containing no post-tensioned diagonal strands which are not parallel to each of said plurality of post-tensioned diagonal strands;

c. first anchoring means attached to each of said first ends for anchoring said first ends into said first edge of said poured-in-place concrete slab section; and d. second anchoring means attached to each of said second ends for anchoring said second ends into said second edge of said poured-in-place concrete slab section, said first and second anchoring means maintaining predetermined effective tensile forces in each of said diagonal strands, said predetermined effective tensile forces acting to produce a longitudinal compressive force in said poured-in-place concrete slab section, said predetermined effective tensile forces also acting to produce a shear force in said poured-in-place concrete slab section, said predetermined angle being selected such that said longitudinal compressive force exceeds a predetermined magnitude and said shear stress is sufficiently low to avoid significiant weakening of said poured-in-place slab section;

whereby, all of said first ends of said post-tensioned diagonal strands are oriented in the same direction along said first edge surface to permit rapid post-tensioning of said post-tensioned diagonal strands without interference from others of said post-tensioned diagonal strands and without requiring reorienting of equipment utilized to perform said post-tensioning of said diagonal strands.

2. The section of prestressed concrete roadway of claim 1 wherein all of said strands are positioned substantially co-planar with respect to each other.

3. The section of prestressed concrete roadway of claim 2 wherein all of said strands form an angle in the range from approximately 2° to approximately 60° with respect to said longitudinal axis.

4. The section of prestressed concrete roadway of claim 2 wherein said section is a section of prestressed concrete railroad roadway and wherein said strands each form an angle of approximately 45° with respect to said longitudinal axis.

5. The section of prestressed concrete roadway of claim 2 wherein all of said strands are positioned in said slab at a depth equal to approximately one half of said thickness.

6. The section of prestressed concrete roadway of claim 1 wherein said predetermined effective tensile forces are approximately twenty-five thousand pounds.

7. The section of prestressed concrete roadway of claim 6 wherein said plurality of post-tensioned cables are distributed on approximately twenty-four inch centers along said longitudinal axis.

8. A method of making a section of prestressed concrete roadway containing a plurality of post-tensioned diagonal strands, said method comprising the steps of:

a. pouring a first quantity of concrete into a region bounded by pre-positioned forms disposed along the edges of said section of prestressed concrete roadway;

b. positioning a plurality of diagonal strands contained in said section of prestressed concrete roadway substantially parallel to each other in said region, each of said diagonal strands being substantially enclosed in flexible plastic sheathing, no diagonal strands which are not substantially parallel to said plurality of diagonal strands being positioned in said section of prestressed concrete roadway;

c. pouring a second quantity of concrete into said region to cover said positioned post-tensioned diagonal strands;

d. curing all of said concrete for a predetermined time; and e. successively tightening anchors of each of said post-tensioned diagonal strands to produce at least a predetermined tensile force in each of said post-tensioned diagonal strands by means of a tensioning machine without reorienting the direction of an anchor-engaging tensioning element of said tensioning machine;

whereby, all of said first ends of said post-tensioned diagonal strands are oriented in the same direction to permit rapid post-tensioning of said post-tensioned strands without interference from others of said post-tensioned diagonal strands and without requiring reorienting of equipment utilized to perform said post-tensioning of said diagonal strands.

* * * * *